US010323816B2

(12) United States Patent
Huber et al.

(10) Patent No.: US 10,323,816 B2
(45) Date of Patent: Jun. 18, 2019

(54) LED MODULE AND LIGHTING DEVICE FOR A MOTOR VEHICLE WITH SEVERAL SUCH LED MODULES

(71) Applicant: Automotive Lighting Reutlingen GmbH, Reutlingen (DE)

(72) Inventors: Ben Huber, Tuebingen (DE); Wolfgang Hossfeld, Gomaringen (DE); Ernst-Olaf Rosenhahn, Bodelshausen (DE); Patrick Ziegler, Schoenaich (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 0 days.

(21) Appl. No.: 15/850,012

(22) Filed: Dec. 21, 2017

(65) Prior Publication Data

US 2018/0180241 A1 Jun. 28, 2018

(30) Foreign Application Priority Data

Dec. 23, 2016 (DE) ..... 10 2016 125 676

(51) Int. Cl.
*F21V 1/00* (2006.01)
*F21S 41/365* (2018.01)
(Continued)

(52) U.S. Cl.
CPC ..... *F21S 41/365* (2018.01); *F21S 41/141* (2018.01); *F21S 41/147* (2018.01); *F21S 41/148* (2018.01);
(Continued)

(58) Field of Classification Search
CPC .. F21S 48/145; F21S 48/1233; F21Y 2101/02
(Continued)

(56) References Cited

U.S. PATENT DOCUMENTS

2006/0126353 A1 6/2006 Ishida
2007/0285939 A1 12/2007 Tachibana
(Continued)

FOREIGN PATENT DOCUMENTS

DE 102005058936 A1 7/2006
EP 0126281 A1 11/1984
(Continued)

OTHER PUBLICATIONS

Examination Report dated Oct. 16, 2017 for German Application No. 10 2016 125 676.5.
(Continued)

*Primary Examiner* — Ahshik Kim
(74) *Attorney, Agent, or Firm* — Howard & Howard Attorneys PLLC

(57) ABSTRACT

A light module of a lighting device of a motor vehicle including at least three optical elements for deflecting the light beams emitted by the light source arranged in succession in the beam path of the emitted light that produces a pre-defined light distribution on a lane in front of the motor vehicle. The first optical element comprises a first reflector element, which reflects the light beams emitted from the light source, the second optical element, which is arranged downstream from the first reflector element in the beam path, comprises a second reflector element and the third optical element, which is arranged downstream from the second reflector element in the beam path, comprises a lens element which, in cooperation with the second reflector element, projects the light beams previously deflected to the two reflector elements to realize the predefined light distribution on the lane in front of the motor vehicle.

14 Claims, 5 Drawing Sheets

(51) Int. Cl.

| | |
|---|---|
| ***F21S 41/25*** | (2018.01) |
| ***F21S 41/141*** | (2018.01) |
| ***F21S 41/40*** | (2018.01) |
| ***F21S 41/147*** | (2018.01) |
| ***F21S 41/32*** | (2018.01) |
| ***F21S 41/663*** | (2018.01) |
| ***F21S 41/148*** | (2018.01) |
| *F21Y 115/10* | (2016.01) |
| *F21S 41/26* | (2018.01) |
| *F21S 41/47* | (2018.01) |
| *F21S 41/683* | (2018.01) |

(52) U.S. Cl.
CPC ..... *F21S 41/25* (2018.01); *F21S 41/321* (2018.01); *F21S 41/323* (2018.01); *F21S 41/40* (2018.01); *F21S 41/663* (2018.01); *F21S 41/26* (2018.01); *F21S 41/47* (2018.01); *F21S 41/683* (2018.01); *F21Y 2115/10* (2016.08)

(58) Field of Classification Search
USPC ..... 362/509
See application file for complete search history.

(56) References Cited

U.S. PATENT DOCUMENTS

| | | | | |
|---|---|---|---|---|
| 2008/0144329 | A1 | 6/2008 | Okuda | |
| 2011/0205748 | A1* | 8/2011 | Yatsuda ..... | F21S 41/147 362/517 |
| 2011/0261576 | A1* | 10/2011 | Uchida ..... | F21S 41/255 362/512 |
| 2014/0307458 | A1 | 10/2014 | Brendle | |

FOREIGN PATENT DOCUMENTS

| | | | |
|---|---|---|---|
| EP | 1193440 | A1 | 4/2002 |
| EP | 1357332 | A2 | 10/2003 |
| EP | 1935715 | A1 | 6/2008 |
| EP | 2436969 | A2 | 4/2012 |
| EP | 2789901 | A2 | 10/2014 |

OTHER PUBLICATIONS

Office Communication for European Patent Application No. 17204713.6 dated Jun. 27, 2018.

* cited by examiner

LED MODULE AND LIGHTING DEVICE FOR A MOTOR VEHICLE WITH SEVERAL SUCH LED MODULES

CROSS-REFERENCE TO RELATED APPLICATIONS

The present application claims priority to and all the benefits of German Patent Application No. 10 2016 125 676.5, filed on Dec. 23, 2016, which is hereby expressly incorporated herein by reference in its entirety.

BACKGROUND OF THE INVENTION

1. Field of the Invention

The present invention relates to a light module of a lighting device of a motor vehicle, the light module comprising a semi-conductor light source for emitting light and at least two optical elements for deflecting the light beams emitted by the light source arranged in succession in the beam path of the emitted light with the object of producing a pre-defined light distribution on a lane in front of the motor vehicle.

Further, the invention relates to a lighting device with at least one such light module. The lighting device comprises a housing, which is preferably made of a synthetic material and has a light passage opening in the light exit direction which is sealed by a transparent cover disk. The at least one light module is arranged in the interior of the housing, either rigidly fastened on the housing or moveably arranged around a horizontal and/or vertical axis, so that by moving the at least one light module relative to the housing a variable headlight range or a bending light functionality can be realized.

The lighting device is preferably a headlight for a motor vehicle. The light module thus serves the purpose of production of a headlight function (e.g. passing light, high beam, fog light, dynamic bending light, adaptive light distribution such as town light, country road light or motorway light) or of part of said function.

2. Description of the Related Art

A lighting device of the initially mentioned type with a single light module is known for example from EP 0 126 281 A1, wherein a first and a second optical element of the light module are both configured as reflector elements. In the beam path between the first and second reflector element the light module has a diaphragm arrangement which screens a portion of the light reflected from the first reflector element and prevents it from hitting the second reflector element, so that the light module produces a dimmed light distribution with an essentially horizontal light/dark boundary. The light distribution is for example a fog light or a passing light with a straight or asymmetrical light/dark boundary. A light source of the light module is in the process arranged in a first focal point of the first reflector element. A first focal point of the second reflector element is congruent with a second focal point of the first reflector element. An edge of the diaphragm arrangement is arranged in the first focal point of the second reflector element. The edge of the diaphragm arrangement is used to form the light/dark boundary of the dimmed light distribution. The first reflector element has an elliptical shape in a vertical section and/or in a horizontal section. The second reflector element is formed by conical segments, or points or sections of the second reflector element can be defined as a free-form reflector whose reflecting surface can be mathematically described. The known light module does not have a lens element, so that the variability of the light module with respect to the achievable magnification factors by which an image of the light source for the realization of the light distribution can be enlarged is restricted to the magnification factors achievable through the use of the two reflector elements.

From EP 1 193 440 A1 a lighting device is known with a single light module, which in a first exemplary embodiment has a reflector element as a first optical element and a lens element as the second optical element. The lens element is used for 'correction' of the light distribution, for example in horizontal direction. The lens element manipulates the light beams without attempting to retain the imaging functionality. A second exemplary embodiment is similar to the light module known from EP 0 126 281 A1. In particular, the known light module comprises an elliptical first reflector element, a diaphragm arrangement and a parabolic second reflector element. In contrast to EP 0 126 281 A1, a surface extension of the diaphragm arrangement is aligned along (and not perpendicular to) an optical axis of the first reflector element and forms a reflecting surface, so that a dimmed light distribution is formed with a light/dark boundary, by reflecting the corresponding light beams in the direction of the second reflector element instead of only dimming them.

SUMMARY OF THE INVENTION

Proceeding from the described prior art, the present invention addresses the problem of designing and further developing a light module of the initially mentioned type such that it forms an imaging system through which the one broad homogeneous light distribution can be produced on the lane in front of the motor vehicle.

Proceeding from the light module of the initially mentioned type, it is proposed to solve this problem by the fact that the light module has a third optical element arranged in the beam path, wherein the first optical element comprises a first reflector element, which reflects at least a portion of the light beams emitted from the light source, the second optical element, which is arranged downstream from the first reflector element in the beam path, comprises a second reflector element and the third optical element, which is arranged downstream from the second reflector element in the beam path, comprises a lens element which in cooperation with the second reflector element projects the light beams previously deflected to the two reflector elements to realize the predefined light distribution on the lane in front of the motor vehicle.

The two reflector elements have collecting or light bundling properties. Each of the reflector elements hence has at least one focal point or at least one focal cloud with a plurality of focal points lying close together. The distance between a focal point of a first focal reflector element and a reflection surface of the reflector element is the focal distance. This can be different or the same for each of the reflector elements in a vertical section and in a horizontal section. Each of the optical elements of the light module is hence involved in the formation of the light distribution such that it bundles reflected (in the case of the reflector elements) light beams or light beams passing through (in the case of the lens element).

The inventive light module hence comprises two reflector elements and a lens element, in order to be able to realize a legal headlight function. The system has approximately imaging properties with respect to a position on the semiconductor light source with a great luminance. This ensures a sufficiently great maximum light intensity in order to provide a high range along the lane. Simultaneously, the plurality of optical elements makes possible a great number of degrees of freedom in the light module, which in turn permit the formation of a broad, homogeneous light distribution pattern on the lane in front of the motor vehicle. The light module can be relatively compact. In particular, the light exit surface from the light module, which as a rule corresponds to the surface of the lens element, can be compact at least on a plane. In the case of a compact configuration of the light exit surface on a vertical plane the light module can be narrow and efficient with vertical dimensions of the lens element of less than 30 mm.

According to an advantageous further development of the invention, it is proposed that the light module comprises a screen element which is arranged in the beam path between the first reflector element and the second reflector element. The screen element can have a surface extension which runs essentially perpendicular to a main reflection direction of the first reflector element. Alternatively, the screen element can also have a surface extension that runs essentially parallel to a main reflection direction of the first reflector element, wherein at least those surfaces of the screen element that are impinged by light beams that are screened by the screen element are reflective.

In comparison to known light modules, in the case of the inventive light modules additional degrees of freedom in the form of additional focal points and additional optical magnification factors have been introduced, by combining the reflectors and—if available—a diaphragm arrangement with an additional lens element, for example a projection lens. Each of the reflector elements and also the lens element then provide two optical magnification factors: one in horizontal direction and one in vertical direction. As a result, the problem of producing the most homogeneous light distribution pattern possible with a predefined horizontal and vertical broadening (diffusion) on the lane in front of the motor vehicle, is allocated to the various optical elements. Simultaneously, the imaging properties of the light module with respect to a position on the semi-conductor light source, which has a high luminance, and—if available—with respect to an edge of the screen element, are preserved. This leads to an especially efficient production of the maximum light intensity close to a horizontal light/darkness boundary, wherein simultaneously the range along the lane is increased. The cooperation of the various focal points, which are used in the light module, permits an adaptation and optimization of the diffusion of the light to the various optical elements, so that an efficient light passage can be combined with a relatively small light exit surface.

According to another advantageous further development of the invention, it is proposed that the first reflector element has an elliptical shape in a vertical section and in a horizontal section. Of course, the shape of the first reflector element can also deviate from a purely elliptical shape and for example, proceeding from the elliptical shape, be distributed over the entire reflection surface (e.g. in the manner of a grid) varied pointwise, so that overall a free-form reflector arises. Further, it is proposed that the first reflector element has two focal points or focal clouds each in the vertical section and in the horizontal section comprising several focal points lying close to one another. It is also advantageous if, for the first reflector element, the focal points or focal clouds overlap the two sections. In this case, the optical magnification factors of the first reflector element would be of equal size in the vertical and in the horizontal section. Of course, it would however also be conceivable that the optical magnification factors of the first reflector element are different in the vertical and in the horizontal section if the focal points or focal clouds of the two sections do not overlap.

Advantageously, the light source is arranged in a first focal point or in the proximity of a first focal cloud of the first reflector element. In the case of an elliptical or approximately elliptical reflector element, the light beams emitted by the nearly punctiform semi-conductor light source are then bundled in the second focal point or in the proximity of the second focal cloud of the first reflector element.

In one embodiment, the second reflector element has a focal point or a focal cloud in both a vertical section and in a horizontal section. Focal points or focal clouds can overlap or also be arranged differently in the space. The second reflector element can have a parabolic shape at least in one section, preferably in a vertical section. The second reflector element can have a longitudinal extension essentially transverse to an optical axis of the first reflector element. The longitudinal extension can in the process be straight or bent or curved around the second focal point or the second focal cloud of the first reflector element. However, it would also be conceivable that the second reflector element has a free form. According to another advantageous further development of the invention, it is proposed that a focal point or focal cloud comprising several focal points of the second reflector element lying close to one another is arranged in a second focal point or in the proximity of a second focal cloud of the first reflector element or that a focal point line comprising several focal points of the second reflector element arranged next to one another runs through a second focal point or a second focal cloud of the first reflector element.

In one embodiment, the second reflector element and the lens element form together a projection unit and are formed dependent on one another and arranged relative to one another such that they project in cooperation an edge of the diaphragm element as a light/dark boundary of the dimmed light distribution onto the lane in front of the motor vehicle. The edge of the diaphragm element, which is projected from the projection unit of the light module as a light/dark boundary of the light distribution onto the lane in front of the motor vehicle, runs advantageously through a second focal point or in the proximity of a second focal cloud of the first reflector element. The configuration of the second reflector element and of the lens element are coordinated such that, for example the lens element, depending on whether the second reflector element has a second focal point, a second focal cloud or a second focal point line, has a first focal cloud or a first focal point line. A second reflector element, for example longitudinally extended in horizontal direction, has a focal point line with a plurality of second focal points of the different vertical sections of the reflector element arranged next to one another. In one vertical section the second reflector element can have a parabolic shape or a free form deviating from it. Accordingly, the lens element would also be longitudinally extended in horizontal direction and have a focal point line with a plurality of first focal points of the different vertical sections of the lens element arranged next to one another. A second focal point of the lens element would preferably be arranged at a great distance to the lens element, preferably arranged in the "infinite", in order to project the light as far as possible in front of the motor vehicle and to achieve a great range of the light distribution.

The present invention also relates to a lighting device which has several inventive light modules arranged next to one another in an installed state in the motor vehicle, wherein the light distributions of the individual light modules overlap with respect to the predefined light distribution of the individual lighting device. In the process, it is also conceivable that all light modules produce identical light distributions, which then overlap with respect to the resulting light distribution of the lighting device. However, alternatively it would also be possible that at least two of the light modules of the lighting device produce different light distributions, so that the different light distributions of the light modules overlap or supplement one another with respect to the resulting light distribution of the lighting device.

To achieve a particularly simple production and assembly of the lighting device or the light modules arranged within, it is proposed that the first reflector elements, the second reflector elements and/or the lens elements of the light modules of the lighting device include a joint integral first reflector element unit, second reflector element unit and/or lens element unit.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE INVENTION

The figures show different embodiments of the present invention. However, the invention is not restricted to the embodiments shown and described here. In particular, individual features of the different embodiments can also be combined with one another otherwise than shown in the figures and described here in order to arrive at a different embodiment of the invention. Identical components in the different figures are marked with the same reference number.

Figure 9:
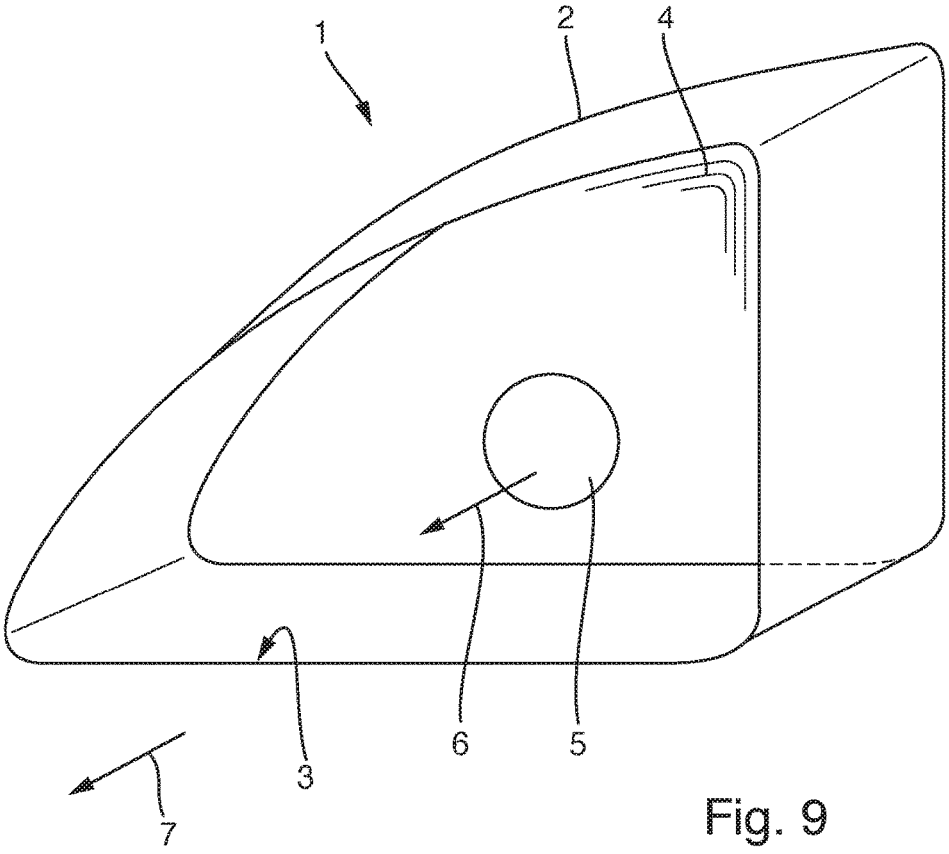
FIG. 9 shows an inventive lighting device in a perspective view.

In FIG. 9 an inventive lighting device of a motor vehicle is marked in its entirety with reference number 1. The lighting device 1 is shown employed as a headlight of a motor vehicle. It comprises a housing 2, which is preferably made of synthetic material and has a light passage opening which is sealed by a transparent cover disk 4, which is preferably likewise made of synthetic material. The lighting device 1 is installed and fastened in an installation position provided for this purpose in a vehicle body of a motor vehicle.

A light module 5 is arranged in the interior of the housing 2. The light module 5 can be pivotably fixed or arranged around a horizontal axis and/or a vertical axis in the housing 2. The light module 5 emits light in a main exit direction 6 which preferably runs parallel to a travel direction 7 of the motor vehicle. Of course, the main exit direction 6 of the light module 5 can also run at least sometimes slightly inclined with respect to the travel direction 7, for example in the case of a variation of the headlight range (upward or downward) or in the case of a realization of a bending light functionality (to the right or to the left). The light module 5 serves the purpose of producing a headlight function (e.g. passing light, high beam, fog light, dynamic bending light, adaptive light distribution such as town light, country road light or motorway light, etc.). Other light modules or luminaire modules (not shown here) can also be arranged in the housing 2. A luminaire module serves the purpose of producing a light function (e.g. daytime running light, navigation or parking light, blinking light, backup light, rear fog light, etc.). In the case of the light module 5, it is a matter of one or more inventive light modules that will subsequently be explained in greater detail on the basis of FIGS. 1 through 8.

Figure 1:
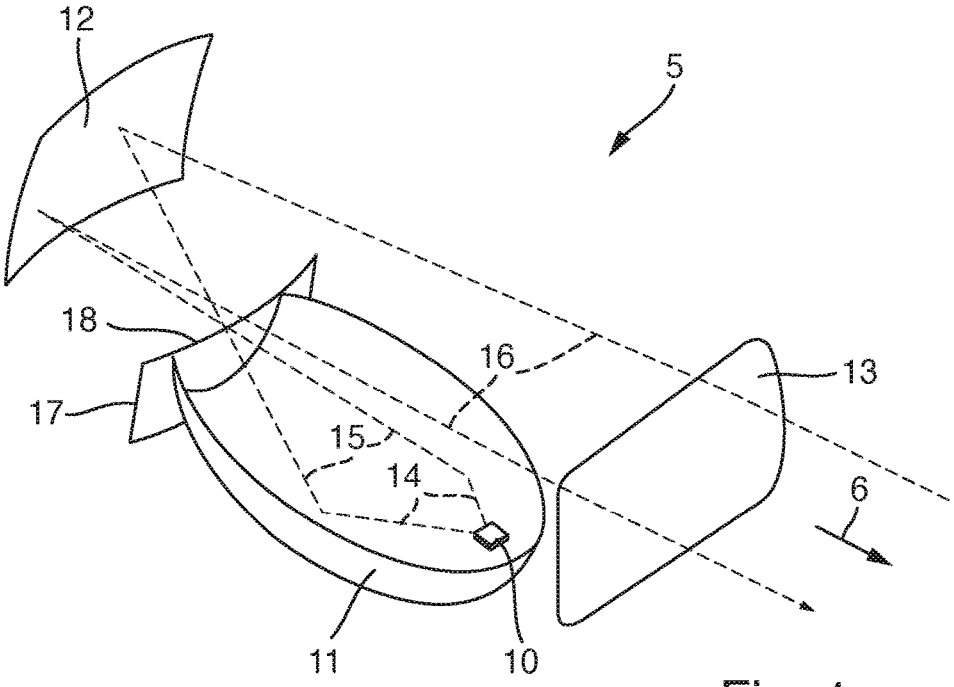
FIG. 1 shows a first preferred embodiment of an inventive light module in a perspective view.
Figure 2:
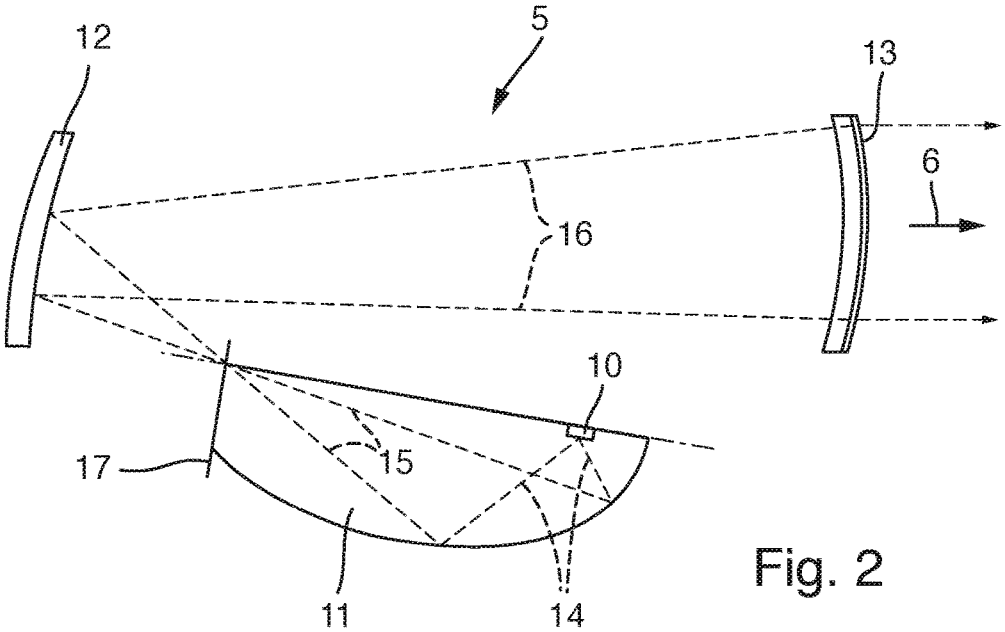
FIG. 2 shows the light module from FIG. 1 in a longitudinal section.

FIGS. 1 and 2 show an example of an inventive light module 5. The light module 5 comprises a semi-conductor light source 10 for emitting light. The light source 10 comprises for example, one or more light diodes (LED). Each light diode can have one or more semi-conductor chips with a light emitting surface for each chip. Further, the light module 5 comprises at least two optical elements 11, 12 arranged in the beam path of the emitted light for deflecting the light beams emitted from the light source 10 with the objective of producing a predefined light distribution on a lane in front of the motor vehicle. In addition, the light module 5 comprises a third optical element 13 arranged in the beam path. The first optical element 11 comprises a first reflector element which deflects a portion of the light beams 14 emitted from the light source 10 in the direction of the second reflector element through reflection (light beams 15). The second optical element 12, which is arranged downstream from the first reflector element 11 in the beam path, comprises a second reflector element which deflects at least a portion of the light beams 15 reflected from the first reflector element 11 in the direction of the third optical element 13 through reflection (light beams 16). The third optical element 13, which is arranged downstream from the second reflector element 12 in the beam path, comprises a lens element which projects the light beams 16 deflected previously to the two reflector elements 11, 12 for realization of the predefined light distribution in the main exit direction 6 to a lane in front of the motor vehicle. In a preferred embodiment the vertical magnification in the case of the second reflector element 12 is greater than the horizontal magnification, and in the case of the lens element 13 the horizontal magnification is greater than the vertical magnification.

For production of a dimmed light distribution (e.g. passing light or fog light) or a portion thereof, the light module 5 comprises a diaphragm element 17, which is arranged in the beam path between the first reflector element 11 and the second reflector element 12. In the example of FIGS. 1 and 2 the diaphragm element 17 has a surface extension which runs essentially perpendicular to a main reflection direction or to an optical axis of the first reflector element 11. An edge 18 of the diaphragm element 17, in the case shown here an upper edge 18 of the diaphragm element 17, is projected by an imaging unit (so-called projection unit) of the light module 5 as a light/dark boundary of the dimmed light distribution onto the lane in front of the motor vehicle. The projection unit is formed in the inventive light module 5 by the second reflector element 12 in cooperation with the lens element 13.

The first reflector element 11 preferably has an elliptical shape in a vertical section and in a horizontal section. However, it would also be conceivable that the reflection surface of the first reflector element 11 has a shape deviating from the elliptical shape, e.g. a free form. The first reflector element 11 has two focal points or focal clouds in the vertical section and in the horizontal section comprising several focal points lying next to one another. Preferably, the focal points or focal clouds of the two sections overlap. In this case, in the vertical section and in the horizontal section there is an equally great magnification factor. Of course, it would also be conceivable that the two focal points, in the vertical section on the one hand, and in the horizontal section on the other hand, do not overlap, so that in both sections different magnification factors arise. The light source 10 is preferably arranged in the first focal point or in the proximity of the first focal cloud of the first reflector element 11. The upper edge 18 of the diaphragm element is preferably arranged in the second focal point or in the proximity of the second focal cloud of the first reflector element 11.

The light module shown in FIGS. 1 and 2 images a point or a region which lies on a light exit surface of the light source 10, on a point or region far in front of the motor vehicle, so that simultaneously the second reflector element 12 and the lens element 13 ensure a sharp image of a point on the edge 18 of the diaphragm element 17. In this way a sufficiently concentrated maximum can be achieved close to the horizontal light/dark boundary of the light distribution.

Figure 3:
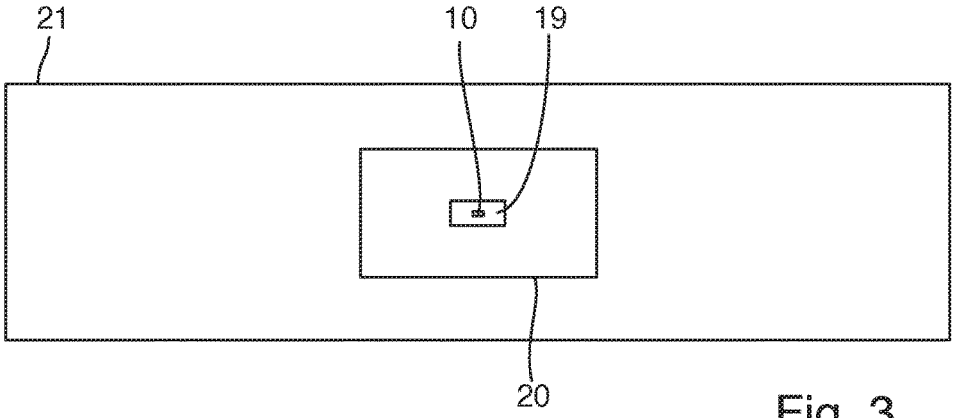
FIG. 3 shows different magnification factors of the different optical elements of an inventive light module.
Figure 4:
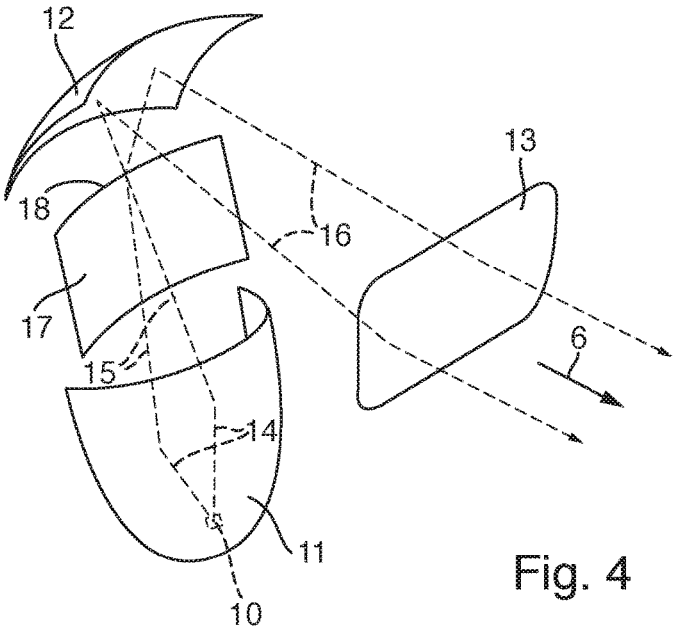
FIG. 4 shows a second preferred embodiment of an inventive light module in a perspective view.

With the help of the optical focal distances which are available in the first reflector element 11, the second reflector element 12 and the lens element 13, the beam path can be influenced and adjusted through the light module 5 as well as the illuminated region on the reflection surface of the second reflector element 12 through light beams 15 and the illuminated region on the light entry surface light entry surface of the lens element 13 through light beams 16. For example, this makes it possible to combine an especially efficient light throughput through the light module 5 with a relatively slim or narrow light exit surface of the lens element 13 or of the total light module 5. Different focal distances in vertical and horizontal sections permit an even more precise adaptation to the desired dimensions of the surfaces of optical elements 11, 12, 13 impinged with light. The selected focal distances of the different optical elements 11, 12, 13 for their part determine the magnification factors M11h (magnification factor of the first reflector element 11 in horizontal direction), M11v (magnification factor of the first reflector element 11 in vertical direction), M12h (magnification factor of the second reflector element 12 in horizontal direction), M12v (magnification factor of the second reflector element 12 in vertical direction), M13h (magnification factor of the lens element 13 in horizontal direction), M13v (magnification factor of the lens element 13 in vertical direction), which can be used to form the resulting light distribution of the light module 5 with respect to their horizontal and vertical extension. This is shown for example in FIG. 3, however, without the effect of the diaphragm element 17. After the first reflector element 11 a magnified image 19 of the light source 10 is produced, here by way of example specified by M11h=5, M11v=5. The second reflector element 12 leads to a further magnified image 20, here by way of example specified by M12h=5, M12v=5. The concluding image 21 in a region far in front of the motor vehicle is achieved with the lens element 13, here by way of example specified by M13h=20, M13v=40. In FIG. 3 the image 21 is scaled with a factor 1/10 according to lens element 13 for the purpose of a better representation.

The light of the light source 10 is bundled with the help of the first reflector element 11 and reflected in the direction of the edge 18 of the diaphragm element 17. Due to the fact that a portion of the light beams 15 is obscured, the diaphragm element 17 has a deciding influence on the formation of the light/dark boundary of the resulting light distribution. The light beams 15 passing the diaphragm element 17 are projected forward in direction 6 or in travel direction 7 of the motor vehicle by the second reflector element 12 and the lens element 13. The second reflector element 12 and the lens element 13 cooperate in order to produce a portion of the dimmed light distribution with the light/dark boundary. A light/dark boundary with a predefined shape, for example an asymmetrical light/dark boundary with a first horizontal section on one's own traffic side, a second horizontal section on the oncoming traffic side, which lies above the first section, and a transverse section roughly between the two sides of traffic, which connects the two sections with one another, can be produced with the help of a correspondingly formed edge 18 of the diaphragm arrangement 17.

The shape of the first reflector element 11 is preferably of the elliptical type with two focal points. The first focal point is oriented toward the position of the light source 10 or its light exit surface (s). The second focal point is preferably oriented toward the edge 18 of the diaphragm arrangement 17. Adjustments for optimization of the light distribution and for complying with statutory provisions can lead to deviations from a precise elliptical shape of the first reflector element 11. The ratios of the focal distances determine the magnification factor M11h or M11v of the first reflector element 11. In one embodiment, an elliptical shape is used, in which case the horizontal and vertical magnification factors are equally great. In some cases however it can be advantageous to use an elliptical shape of the first reflector element 11, in which case the focal distances in vertical and horizontal direction are different, so that different magnification factors M11h, M11v arise. The selection of focal distances is additionally used to influence the angle of a widening (diffusion) of the light beams 15 and accordingly the illuminated region of the second reflector element 12. In principle, given the above boundary conditions any type of free-form surface can be used for the first reflector element 11.

The second reflector element 12 cooperates directly with the lens element 13. The combination of the two optical elements 12, 13 preferably projects a point or region on the edge 18 of the diaphragm element 17 in a point or region far in front of the motor vehicle. Hence, the optical task is allocated to the two separate optical elements 12, 13, leading to further degrees of freedom with respect to the focal points and the optical magnification factors. The first focal point of the second reflector element 12 is arranged on the edge 18 of the diaphragm element 17, while the second focal point of the second reflector element 12 offers several possibilities for realization. FIG. 2 shows lateral view of the light module 5, in which case the second reflector element 12 leads to a beam path of light beams 16, said light beams diverging slightly in vertical direction in the direction of the lens element 13. The setting of the focal distances on the second reflector element 12 can be used to influence the angle of a widening (diffusion) of the light beams 16 and accordingly the illuminated region on the light entry surface of the lens element 13. A converging route of the light beams 16 between the second reflector element 12 and the lens element 13 would even be conceivable. These additional degrees of freedom are available for a formation of the beam path of the light beams 16, which is advantageous for the design and the development of narrow, slender and efficient light modules 5 and lighting devices 1 with slight vertical dimensions of the light exit surface (of the lens element 13), preferably of less than 30 mm. The ratio of the selected focal distances of the second reflector element 12 determines the horizontal and vertical magnification factors M12h, M12v of the second reflector element 12. These magnification factors M12h, M12v can be varied relative to one another, for example by replacing the point-like second focal point of the second reflector element 12 with a focal point line, under circumstances even with a bend on the horizontal plane. In this case, the radius of the bend, which can also be selected virtually in perpetuity, can determine the value of the horizontal magnification factor M12h, and can hence contribute to the formation of the horizontal diffusion of the resulting light distribution.

The imaging task is fulfilled by the second reflector element 12 in cooperation with the lens element 13, wherein the edge 18 of the diaphragm element 17 is projected to a position far in front of the motor vehicle, which corresponds approximately to a point-to-point projection. Thus, the shape of the lens element 13 has a direct mathematical relationship to the shape of the second reflector element 12 or its reflection surface and varies depending on the degree of the light divergence or convergence. In order to be able to ensure approximately imaging properties, the lens element 13 uses a first focus (e.g. focal point, focal cloud or focal point line, straight or bent) which is exactly like the second focus (e.g. focal point, focal cloud or focal point line, straight or bent) of the second reflector element 12. The second focus of the lens element, which is ordinarily configured as a focal point, is arranged far in front of the motor vehicle. The corresponding ratio of the focal distances leads to the horizontal and vertical magnification factors M13h, M13v of the lens element 13.

The diaphragm element 17 can be realized essentially in two ways. For one, it can be realized as a pure diaphragm element, which 'only' obscures impinging light beams which the lens element 13 would leave in directions above the desired horizontal light/dark boundary of the resulting light distribution, so that these light beams do not contribute to the production of the light distribution. With the help of a slight offset of the light source 10 from the first focal point of the first reflector element 11, as a result of which it is ensured that the majority of the light beams 15 bundled by the first reflector element 11 pass through the light module 5 and can contribute in the production of the light distribution (and not be obscured by the diaphragm element 17), the efficiency of the light module 5 can be significantly improved. In the process, a component of the main direction of emission of the light source 10 can be directed against the travel direction of the motor vehicle.

For another, the diaphragm element 17 can have at least partially mirrored surfaces. The mirrored surface is preferably oriented toward the optical axis of the first reflector element 11 and on a corresponding place of the diaphragm element 17. Such a light module 5 is for example shown in FIGS. 4 and 5. In the process, the diaphragm element 17 has a surface extension which runs essentially parallel to a main reflection direction or to an optical axis of the first reflector element 11. Preferably, at least those surfaces of the diaphragm element 17 that are impinged by the light beams 15 are reflective. In this way, the light beams 15 obscured by the diaphragm element 17 are not lost, but rather can be reflected in the resulting dimmed light distribution, preferably compact below the light/dark boundary. An edge 18 of the diaphragm element 17, in the case shown here a front edge 18 of the diaphragm element 17, is projected by the imaging unit 12, 13 (so-called projection unit) of the light module 5 as the light/dark boundary of the dimmed light distribution onto the lane in front of the motor vehicle. In the process, a component of the main direction of emission of the light source 10 is directed in the travel direction of the motor vehicle.

The shape and orientation of the diaphragm element 17 is then used to form the horizontal light/dark boundary of the light distribution. Due to the reflecting properties of the diaphragm element 17, the second reflector element 12 must be able to manage an interim light distribution, which in comparison to the interim light distribution in the light module 5 from FIGS. 1 and 2, is inversely oriented. This explains the opposing orientation and arrangement of the first reflector element 11 in the case of the two different light modules 5.

Although the inventive light module 5 (double reflector lens system) is described here as an imaging system, it would be possible to use slight variations of stringent imaging components. Such variations can, for example, be necessary to optimize the resulting light distribution and/or ensure the lighting device's compliance with the law.

Figure 5:
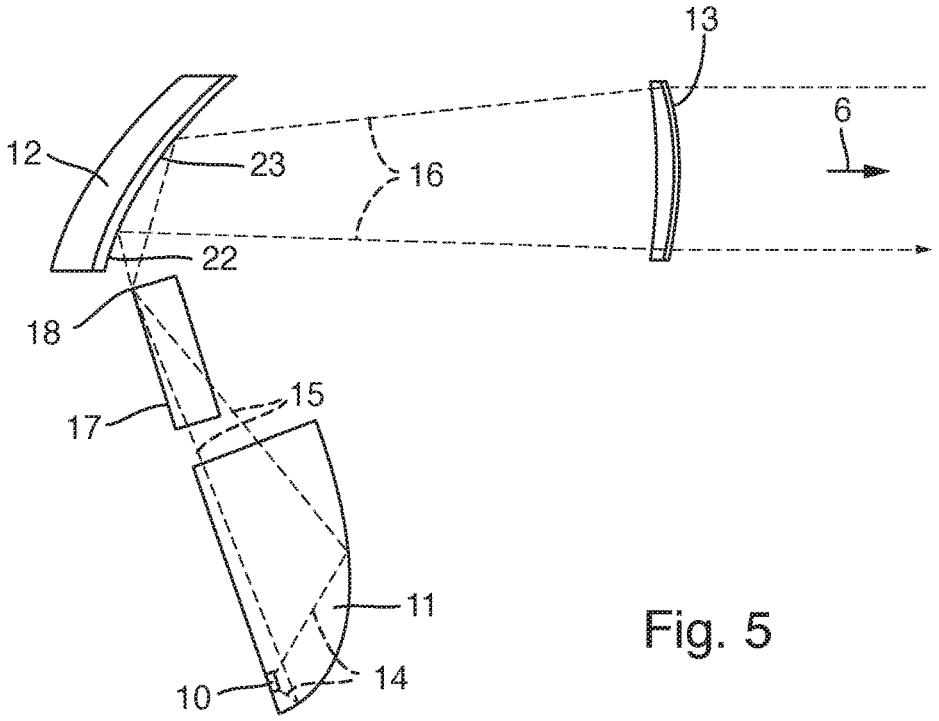
FIG. 5 shows the light module from FIG. 4 in a longitudinal section.
Figure 6:
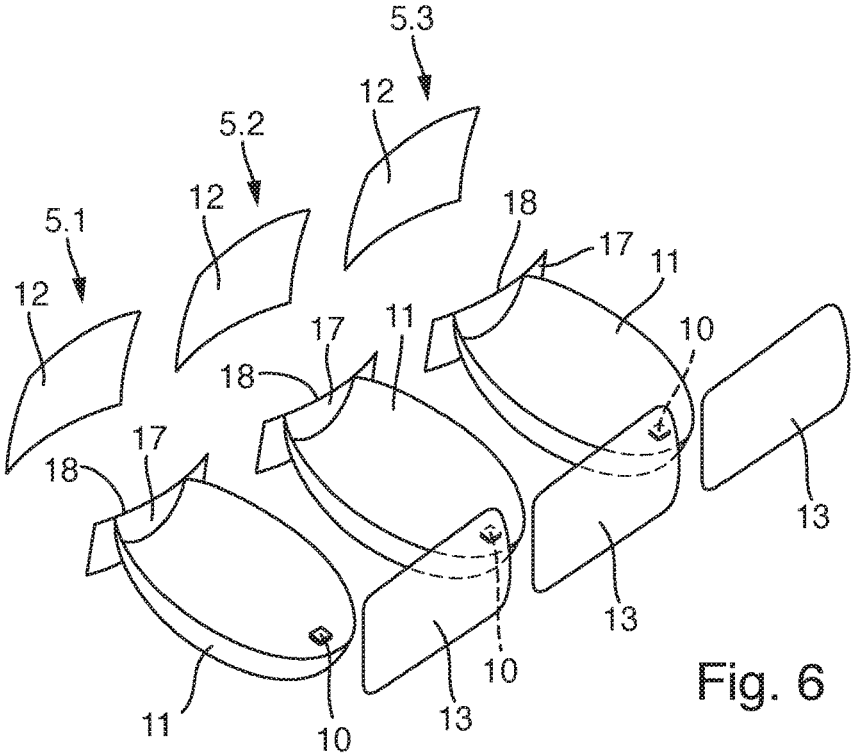
FIG. 6 shows several light modules from FIG. 1 arranged next to one another in a perspective view.
Figure 7:
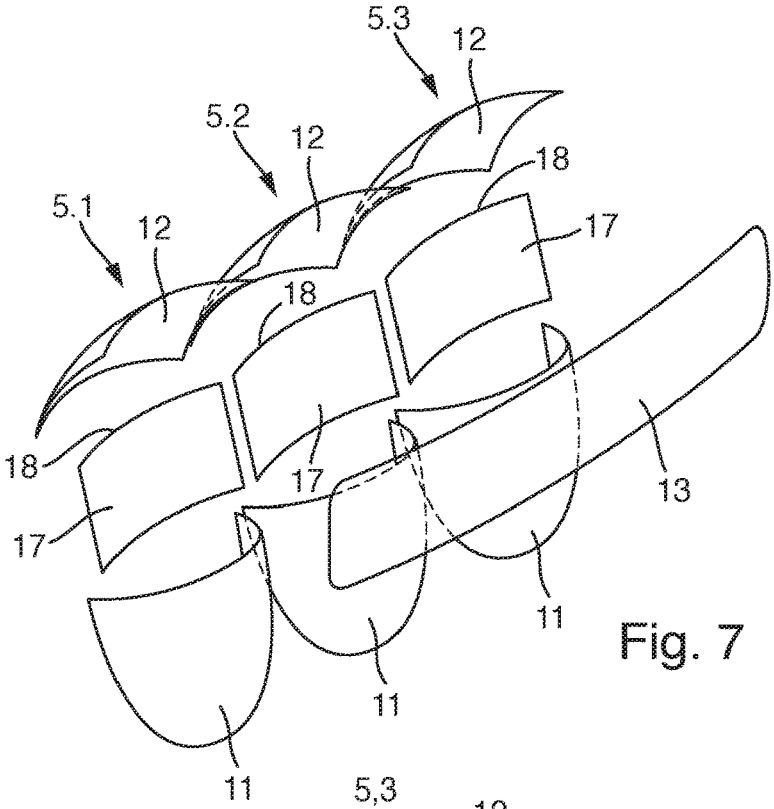
FIG. 7 shows several light modules from FIG. 4 arranged next to one another in a perspective view.
Figure 8:
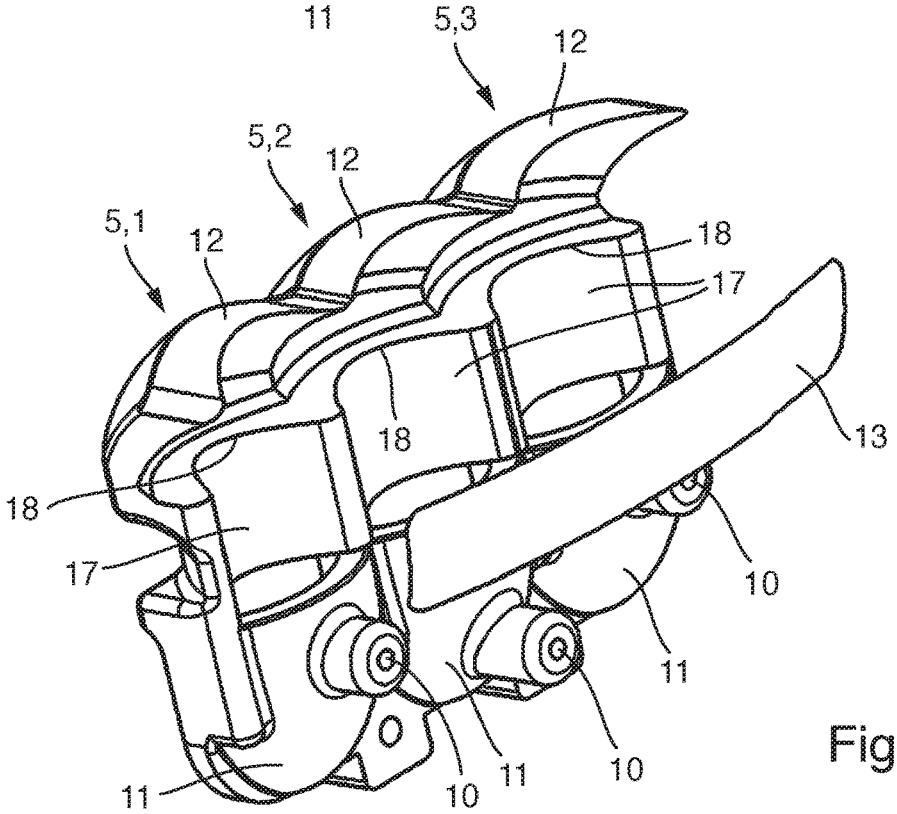
FIG. 8 shows a further embodiment with several light modules arranged next to one another in a perspective view.

The second reflector element 12 or its reflection surface can also have a region or section 22, which provides a so-called overhead light, thus a slight illumination of a region of the light distribution above the horizontal light/dark boundary (cf. FIG. 5). The actual reflection surface of the reflector element 12 is marked with reference number 23, and the additional section or region for the overhead lighting is marked with reference number 22. The shape and orientation of the section 22 can be completely independent from the shape and orientation of the reflection surface 23. Here, the possibility exists that the section 22 uses light that otherwise would not pass through the lens element 13 and would not participate in the production of the light distribution.

The diaphragm element 17 can also be movable in order to facilitate or make possible a mechanical shifting of the resulting light distribution between the dimmed light distribution and a high beam distribution.

In the motor vehicle a lighting device 1 is mounted in the front region on each side (one's actual own traffic side and the oncoming traffic side). For each inventive lighting device 1 the resulting light distribution can be produced either by an individual inventive light module 5 or through a combination of several light modules 5. It is conceivable to combine several light modules 5 with one another per lighting device 1, each having a first reflector element 11, a second reflector element 12, a separate lens element 13 and—if available—a diaphragm element 17 (cf. FIG. 6). The individual submodules are marked 5.1, 5.2 and 5.3. Of course, a different number of submodules can also be combined with one another than the one shown in the figures. Another possibility would be to combine several light modules 5 per lighting device 1 which have a common lens element 13 (cf. FIG. 7). In both cases, the resulting light distribution of the lighting device 1 would then correspond to a superposition or supplementation of the individual light distributions of the individual light modules 5.1, 5.2 and 5.3. Two possible scenarios for superposition could be:

Each of the submodules 5.1, 5.2 and 5.3 produces approximately the same type of individual light distribution with similar horizontal and vertical diffusion. In this case, the angles of diffusion must be provided as well in about ⅓ of the desired light intensity values by each of the submodules 5.1, 5.2 and 5.3.

Each of the submodules 5.1, 5.2 and 5.3 produces an individual light distribution which illuminates the different regions of the resulting light distribution of the lighting device 1. Each of the submodules 5.1, 5.2 and 5.3 produces different types individual light distribution with different horizontal and vertical diffusion and/or different light intensity values. In one example, the submodule 5.1 could be responsible for a broad horizontal illumination (so-called basic light); the submodule 5.3 could be responsible for a concentrated illumination of a long-distance range (so-called spotlight) and the submodule 5.2 could be responsible for an illumination of an intermediate range between the broad horizontal illumination and the concentrated illumination of the long-distance range. The illumination through submodule 5.2 could design more evenly the transitions between the broad horizontal illumination of the long-distance range.

Submodule 5.1 produces a basic light, submodules 5.2 and 5.3 produce identical or similar spotlight distributions in order to increase or emphasize the range of the light distribution onto the lane.

The individual light distributions of the individual submodules 5.1, 5.2 and/or 5.3 can be coordinated and adjusted by slightly shifting the modules, e.g. by vertical coordination of a horizontal light/dark boundary of the resulting total light distribution or by horizontal coordination of light distribution focal points, in order to comply with the legal requirements for the resulting total light distribution. The shifting of the modules occurs preferably by shifting (perpendicular to the travel direction of the motor vehicle) of the second focal point (in the "infinite") of the system (second reflector element 12 and lens element 13) and can be customized for each of the submodules 5.1, 5.2 and 5.3.

In case several submodules 5.1, 5.2 and 5.3 are combined with one another, it could be advantageous to form the individual components of the reflector elements 11 and 12 of the individual light modules 5 as a common integral component, for example by injection molding or milling. This is shown as an example for three light modules 5 in FIG. 8, in this case with a common lens element 13.

For the production of an asymmetrical light distribution, a light module 5 can be rotated or inclined around an optical axis (parallel to the light exit direction 6), or the light source 10 is arranged outside of the focal point of the first reflector element 11. Thus, for example in the case of the exemplary embodiment from FIG. 5, the light source 10 can be shifted laterally perpendicular to the plane of projection. In this way, a light distribution can also be shifted. Thus e.g. a basic light can be shifted in each case to the motor vehicle exterior and thus the total light distribution can be broadened.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

We claim:

1. A light module of a lighting device of a motor vehicle, the light module comprising a semi-conductor light source for emitting light and at least two optical elements for deflecting the light beams emitted by the light source arranged in succession in the beam path of the emitted light with the object of producing a pre-defined light distribution on a lane in front of the motor vehicle, wherein the light module comprises a diaphragm element, which is arranged in the beam path between the first reflector element and the second reflector element, wherein the light module has a third optical element arranged in the beam path, wherein the first optical element comprises a first reflector element, which reflects at least a portion of the light beams emitted from the light source, the second optical element, which is arranged downstream from the first reflector element in the beam path, comprises a second reflector element and the third optical element, which is arranged downstream from the second reflector element in the beam path, comprises a lens element which, in cooperation with the second reflector element, projects the light beams previously deflected to the two reflector elements to realize the predefined light distribution on the lane in front of the motor vehicle, wherein the first reflector element and the second reflector element each have collecting properties.

2. The light module as set forth in claim 1, wherein the diaphragm element has a surface extension which runs essentially perpendicular to a main reflection direction of the first reflector element.

3. The light module as set forth in claim 1, wherein the diaphragm element has a surface extension which runs essentially parallel to a main reflection direction of the first reflector element, wherein, at least those surfaces of the diaphragm element that are impinged by the light beams, which are obscured by the diaphragm element, are reflective.

4. The light module as set forth in claim 1, wherein the first reflector element has an elliptical shape in a vertical section and in a horizontal section.

5. The light module as set forth in claim 4, wherein the first reflector element has two focal points or focal clouds each in the vertical section and in the horizontal section comprising several focal points lying close to one another.

6. The light module as set forth in claim 5, wherein the focal points or focal clouds of the two sections overlap.

7. The light module as set forth in claim 1, wherein the light source is arranged in a first focal point or in the proximity of a first focal cloud of the first reflector element.

8. The light module as set forth in claim 1, wherein a focal point or focal cloud comprising several focal points of the second reflector element lying close to one another is arranged in a second focal point or in the proximity of a second focal cloud of the first reflector element or that a focal point line comprising several focal points of the second reflector element arranged next to one another runs through a second focal point or a second focal cloud of the first reflector element.

9. The light module as set forth in claim 1, wherein an edge of the diaphragm element runs through a second focal point or in the proximity of a second focal cloud of the first reflector element.

10. The light module as set forth in claim 1, wherein the second reflector element and the lens element form together a projection unit and are formed dependent on one another and arranged relative to one another such, that they project in cooperation an edge of the diaphragm element as a light/dark boundary of the dimmed light distribution onto the lane in front of the motor vehicle.

11. The light module as set forth in claim 1, wherein the lens element, depending on whether the second reflector element has a second focal point, a second focal cloud or a second focal point line, correspondingly has a first focal cloud or a first focal point line.

12. The light module as set forth in claim 1, wherein the lens element has a second focal point or a second focal cloud that is arranged at a great distance from the light module in front of the motor vehicle.

13. A lighting device of a motor vehicle for producing a predefined light distribution on a lane in front of the motor vehicle, wherein the lighting device has several light modules arranged next to one another in an installed state in the motor vehicle, wherein each light module comprises a semi-conductor light source for emitting light and at least two optical elements for deflecting the light beams emitted by the light source arranged in succession in the beam path of the emitted light with the object of producing a predefined light distribution on a lane in front of the motor vehicle, wherein the light module has a third optical element arranged in the beam path, wherein the first optical element comprises a first reflector element, which reflects at least a portion of the light beams emitted from the light source, the second optical element, which is arranged downstream from the first reflector element in the beam path, comprises a second reflector element and the third optical element, which is arranged downstream from the second reflector element in the beam path, comprises a lens element which, in cooperation with the second reflector element, projects the light beams previously deflected to the two reflector elements to realize the predefined light distribution on the lane in front of the motor vehicle, wherein the first reflector element and the second reflector element each have collecting properties; wherein the light distributions of the individual light modules overlap with respect to the predefined light distribution of the lighting device and at least two of the light modules of the lighting device produce different light distributions.

14. The lighting device as set forth in claim 13, wherein the first reflector elements, the second reflector elements or the lens elements of the light modules of the lighting device include a joint integral first reflector element unit, second reflector element unit and/or lens element unit.

* * * * *